US008427078B2

(12) United States Patent
Naito et al.

(10) Patent No.: US 8,427,078 B2
(45) Date of Patent: Apr. 23, 2013

(54) LIGHT-EMITTING ELEMENT DRIVING DEVICE AND DISPLAY DEVICE

(75) Inventors: Takahiro Naito, Tokyo (JP); Yasushi Katayama, Kanagawa (JP); Tatsuki Nishino, Tokyo (JP)

(73) Assignee: Sony Corporation, Tokyo (JP)

( * ) Notice: Subject to any disclaimer, the term of this patent is extended or adjusted under 35 U.S.C. 154(b) by 249 days.

(21) Appl. No.: 13/064,051

(22) Filed: Mar. 3, 2011

(65) Prior Publication Data

US 2011/0285313 A1 Nov. 24, 2011

(30) Foreign Application Priority Data

May 19, 2010 (JP) ..... 2010-115239

(51) Int. Cl.
*G09G 3/32* (2006.01)
*H05B 37/02* (2006.01)

(52) U.S. Cl.
USPC ..... 315/307; 315/294; 345/102

(58) Field of Classification Search ..... 315/307, 315/308, 291, 312, 294, 297; 345/82, 102
See application file for complete search history.

(56) References Cited

U.S. PATENT DOCUMENTS 7,777,704 B2 * 8/2010 S et al. ..... 345/82
2010/0109563 A1 * 5/2010 Gong et al. ..... 315/294

FOREIGN PATENT DOCUMENTS

JP 2001-272938 10/2001

* cited by examiner

*Primary Examiner* — Daniel D Chang
(74) *Attorney, Agent, or Firm* — Rader, Fishman & Grauer PLLC

(57) ABSTRACT

A light-emitting element driving device includes: a plurality of light emitters; a power supply; a plurality of current control transistors; a plurality of constant-current circuits; a voltage selecting circuit; a control circuit; and a voltage controller.

10 Claims, 6 Drawing Sheets

LIGHT-EMITTING ELEMENT DRIVING DEVICE AND DISPLAY DEVICE

BACKGROUND OF THE INVENTION

1. Field of the Invention

The present invention relates to a light-emitting element driving device for driving a light-emitting element such as a light-emitting diode (LED) or the like which emits light at a luminance level depending on a current flowing therethrough, and a display device having a non-emission transmissive display unit which incorporates such a light-emitting element driving device.

2. Description of the Related Art

The backlight of a liquid crystal display panel employs LEDs as its light source which have replaced a CCFL (Cold Cathode Fluorescent Lamp) employing a fluorescent tube.

Particularly, backlights including individual primary LEDs such as red LEDs, green LEDs, and blue LEDs for producing white light according to an optical additive color synthesis have been used in television applications as they can easily achieve good color balances. In recent years, white LEDs with improved color rendition have widely been used television applications.

An LED basically has such characteristics that its luminance varies depending on a current supplied thereto, and has a forward voltage which differs depending on individual LED variations and temperatures.

Therefore, when LEDs are used as the backlight of a liquid crystal display panel, a driving device for those LEDs is required to have constant-current characteristics in order to achieve a constant uniform luminance level.

There is known a driving device which adopts a PWM control process for turning on and off a current flowing through an LED with certain timing and adjusting a luminance level based on the ratio of the on and off periods in order to adjust the luminance level stably in a wide dynamic range.

According to one of schemes for realizing the PWM control process, a switch element is inserted in series to the LED to turn on and off the LED with prescribed timing (see Japanese Patent Laid-Open No. 2001-272938), for example).

There is also known a process for turning on and off switch elements connected in series to LEDs with energization signals to control switching transistors of a switching power supply such as a boosting chopper or the like according to a PWM control process.

FIG. 1 of the accompanying drawings is a circuit diagram, partly in block form, of a light-emitting element (LED) driving device according to the related art.

As shown in FIG. 1, an LED driving device 1 includes a booster-chopper-type switching power supply 2 and a plurality of light emitters 3-1 through **3-*n* (n=2 in FIG. 1**) as loads including LED arrays each including a plurality of series-connected LEDs. It is assumed that n=2 in the description which follows.

The LED driving device 1 also includes a constant-current controlling switching transistor 4-1 and a constant-current circuit 5-1 which are connected in series to the light emitter 3-1, and a constant-current controlling switching transistor 4-2 and a constant-current circuit 5-2 which are connected in series to the light emitter 3-2.

The LED driving device 1 further includes switch drivers 6-1, 6-2, a minimum voltage selecting circuit 7, and a control circuit 8.

The switching power supply 2 includes a constant-voltage source V21, an inductor L21, a diode D21, an electric storage capacitor C21, a switching transistor SW21, a current detecting resistive element R21, and nodes ND21 through ND23.

The inductor L21 has an end connected to the constant-voltage source V21 which has a voltage VDD and an opposite end connected to the node ND21. The diode D21 has an anode connected to the node ND21 and a cathode connected to the node ND22. The capacitor C21 has a terminal (electrode) connected to the node ND22 and another terminal (electrode) connected to a reference potential VSS, e.g., a ground potential.

The node ND22 is connected as a voltage output node of the switching power supply 2 to respective ends of the light emitters 3-1, 3-2.

The switching transistor SW21 includes an NMOS transistor which is an n-channel field-effect transistor, for example. The switching transistor SW21 has a drain connected to the node ND21 and a source connected to an end of the resistive element R21. The other end of the resistive element R21 is connected to the reference potential VSS.

The switching power supply 2 thus constructed operates as follows: The control circuit 8 supplies a PWM-controlled pulse signal to turn on and off the switching transistor SW21 to boost the voltage VDD of the constant-voltage source V21. The switching power supply 2 supplies the boosted voltage VDD as a voltage Vo to the ends of the light emitters 3-1, 3-2.

Each of the light emitters 3-1, 3-2 includes a series-connected array of LEDs 31 through **3*m***.

The LED 31 on an end of the series-connected array of each of the light emitters 3-1, 3-2 has an anode connected to the voltage output node ND22 of the switching power supply 2.

The LED **3*m* on the other end of the series-connected array of the light emitter 3-1 has a cathode connected to the drain (one terminal) of the switching transistor 4-1**.

The LED **3*m* on the other end of the series-connected array of the light emitter 3-2 has a cathode connected to the drain (one terminal) of the switching transistor 4-2**.

Each of the light emitters 3-1, 3-2 is not limited to a plurality of LEDs, but may include a single LED.

The switching transistor 4-1 has a source (other terminal) connected to a terminal of the constant-current circuit 5-1, whose other terminal is connected to the reference potential VSS.

The switching transistor 4-1 remains turned on during the period of an active high level of a pulsed LED energization signal LO1 that is supplied via the switch driver 6-1 to the gate of the switching transistor 4-1.

At this time, a current ILED flows into the light emitter 3-1 which is supplied with the voltage Vo from the switching power supply 2, energizing the LEDs 31 through **3*m* of the light emitter 3-1**.

The switching transistor 4-1 remains turned off during the period of a non-active low level of the pulsed LED energization signal LO. At this time, no current ILED flows into the light emitter 3-1 which is supplied with the voltage Vo from the switching power supply 2, de-energizing the LEDs 31 through **3*m* of the light emitter 3-1**.

While the switching transistor 4-1 is being energized, a monitor voltage Vs1 at a junction node ND1 between the switching transistor 4-1 and the constant-current circuit 5-1 is as follows:

The monitor voltage Vs1 is calculated by subtracting the sum ΣVf (=VF) of forward voltages Vf of all the LEDs 31 through **3*m* of the light emitter 3-1 from the voltage Vo supplied from the switching power supply 2**.

The monitor voltage Vs1 thus calculated does not take into account a voltage drop across the switching transistor 4-1.

If the switching transistor 4-1 includes a field-effect transistor (FET), then the monitor voltage Vs1 at the junction node ND1 is calculated by subtracting the sum ΣVf of the forward voltages Vf of all the LEDs 31 through 3*m* of the light emitter 3-1 and a drain-to-source voltage Vds1 of the FET as the switching transistor 4-1 from the voltage Vo supplied from the switching power supply 2.

The constant-current controlling switching transistor 4-2 has a source (other terminal) connected to a terminal of the constant-current circuit 5-2, whose other terminal is connected to the reference potential VSS.

The switching transistor 4-2 remains turned on during the period of an active high level of a pulsed LED energization signal LO2 that is supplied via the switch driver 6-2 to the gate of the switching transistor 4-2.

At this time, a current ILED flows into the light emitter 3-2 which is supplied with the voltage Vo from the switching power supply 2, energizing the LEDs 31 through 3*m* of the light emitter 3-2.

The switching transistor 4-2 remains turned off during the period of a non-active low level of the pulsed LED energization signal LO2. At this time, no current ILED flows into the light emitter 3-2 which is supplied with the voltage Vo from the switching power supply 2, de-energizing the LEDs 31 through 3*m* of the light emitter 3-2.

While the switching transistor 4-2 is being energized, a monitor voltage Vs2 at a junction node ND2 between the switching transistor 4-2 and the constant-current circuit 5-2 is as follows:

The monitor voltage Vs2 is calculated by subtracting the sum ΣVf (=VF) of forward voltages Vf of all the LEDs 31 through 3*m* of the light emitter 3-2 from the voltage Vo supplied from the switching power supply 2.

The monitor voltage Vs2 thus calculated does not take into account a voltage drop across the switching transistor 4-2.

If the switching transistor 4-2 includes a field-effect transistor (FET), then the monitor voltage Vs2 at the junction node ND2 is calculated by subtracting the sum ΣVf of the forward voltages Vf of all the LEDs 31 through 3*m* of the light emitter 3-2 and a drain-to-source voltage Vds2 of the FET as the switching transistor 4-2 from the voltage Vo supplied from the switching power supply 2.

The minimum voltage selecting circuit 7 selects a minimum voltage Vsmin from the monitor voltages Vs1, Vs2 at the nodes ND1, ND2 which are calculated by subtracting the voltage drops across the light emitters 3-1, 3-2 and the switching transistors 4-1, 4-2 from the voltage Vo, and supplies the selected minimum voltage Vsmin to the control circuit 8.

The control circuit 8 supplies the gate of the switching transistor SW21 with a pulse signal having a pulse duration depending on the minimum voltage Vsmin selected by the minimum voltage selecting circuit 7.

The switching power supply 2 boosts the voltage VDD of the constant-voltage source V21 by turning on and off the switching transistor SW21 with the pulse signal supplied to the gate thereof.

In this manner, the voltage at the constant-current control terminal of the light emitter 3-1 or 3-2 under the maximum voltage VF is controlled at a constant level.

SUMMARY OF THE INVENTION

As described above, since the voltage at the constant-current control terminal of the light emitter 3-1 or 3-2 under the maximum voltage VF can be controlled at a constant level, the output voltage Vo of the switching power supply 2 can be controlled at a minimum voltage required.

As a result, it is possible to apply a sufficient voltage to the constant-current circuits 5-1, 5-2 to drive the light emitters 3-1, 3-2, each including an LED array as a load, with a constant current.

However, if the forward voltage Vf of each LED varies to a value lower than a standard value, for example, then the voltages applied to the constant-current circuits 5-1, 5-2 increase, increasing power consumption of the constant-current circuits 5-1, 5-2 and reducing electric power efficiency thereof.

Particularly, an increase in the power consumption of the constant-current circuit 5-1 or 5-2 connected to the light emitter 3-1 or 3-2 which is not under the maximum voltage VF is greatly responsible for a reduction in the electric power efficiency, and is also liable to cause the constant-current circuit 5-1 or 5-2 to generate undue heat.

It is desirable to provide a light-emitting element driving device and a display device which are capable of reducing a maximum voltage across a constant-current circuit to minimize a power loss of the constant-current circuit and reduce heat generated thereby.

According to an embodiment of the present invention, there is provided a light-emitting element driving device including a plurality of light emitters each including at least one light-emitting element for emitting light at a luminance level depending on a current flowing therethrough, a power supply for adjusting an output voltage depending on a signal supplied to a control terminal of a switch device and supplying the output voltage to ends of the light emitters, a plurality of current control transistors connected between respective other ends of the light emitters and a reference potential, the current control transistors being rendered conductive by respective energization signals, a plurality of constant-current circuits connected respectively in series to the current control transistors between the other ends of the light emitters and reference potential, a voltage selecting circuit for selecting a minimum voltage and a maximum voltage from junction terminal voltages between the current control transistors and the constant-current circuits, a control circuit for outputting a signal having a pulse duration depending on the minimum voltage selected by the voltage selecting circuit, to the control terminal of the switch device, and a voltage controller for generating a control voltage so as to make the maximum voltage selected by the voltage selecting circuit equal to or smaller than a preset maximum reference voltage and setting the level of the energization signals to the level of the control voltage.

According to another embodiment of the present invention, there is provided a display device including a transmissive display unit, an illumination unit for illuminating the transmissive display unit with emitted light, the illumination unit including a plurality of light emitters each including at least one light-emitting element for emitting light at a luminance level depending on a current flowing therethrough, and a light-emitting element driving device for driving the light-emitting elements of the light emitters. The light-emitting element driving device includes a power supply for adjusting an output voltage depending on a signal supplied to a control terminal of a switch device and supplying the output voltage to ends of the light emitters, a plurality of current control transistors connected between respective other ends of the light emitters and a reference potential, the current control transistors being rendered conductive by respective energization signals, a plurality of constant-current circuits connected respectively in series to the current control transistors between the other ends of the light emitters and reference potential, a voltage selecting circuit for selecting a minimum voltage and a maximum voltage from junction terminal voltages between the current control transistors and the constant-current circuits, a control circuit for outputting a signal having a pulse duration depending on the minimum voltage selected by the voltage selecting circuit, to the control terminal of the switch device, and a voltage controller for generating a control voltage so as to make the maximum voltage selected by the voltage selecting circuit equal to or smaller than a preset maximum reference voltage and setting the level of the energization signals to the level of the control voltage.

According to the present invention, it is possible to reduce the maximum voltage applied to the constant-current circuits, to reduce the power losses caused by the constant-current circuits, and hence to reduce the heat generated thereby.

DETAILED DESCRIPTION OF THE PREFERRED EMBODIMENTS

Preferred embodiments of the present invention will be described below with reference to the drawings.

The preferred embodiments will be described below according to the following order.

1. First embodiment (first configuration example of light-emitting element (LED) driving device)
2. Second embodiment (second configuration example of light-emitting element (LED) driving device)
3. Third embodiment (display device)

1. First Embodiment

Figure 2:
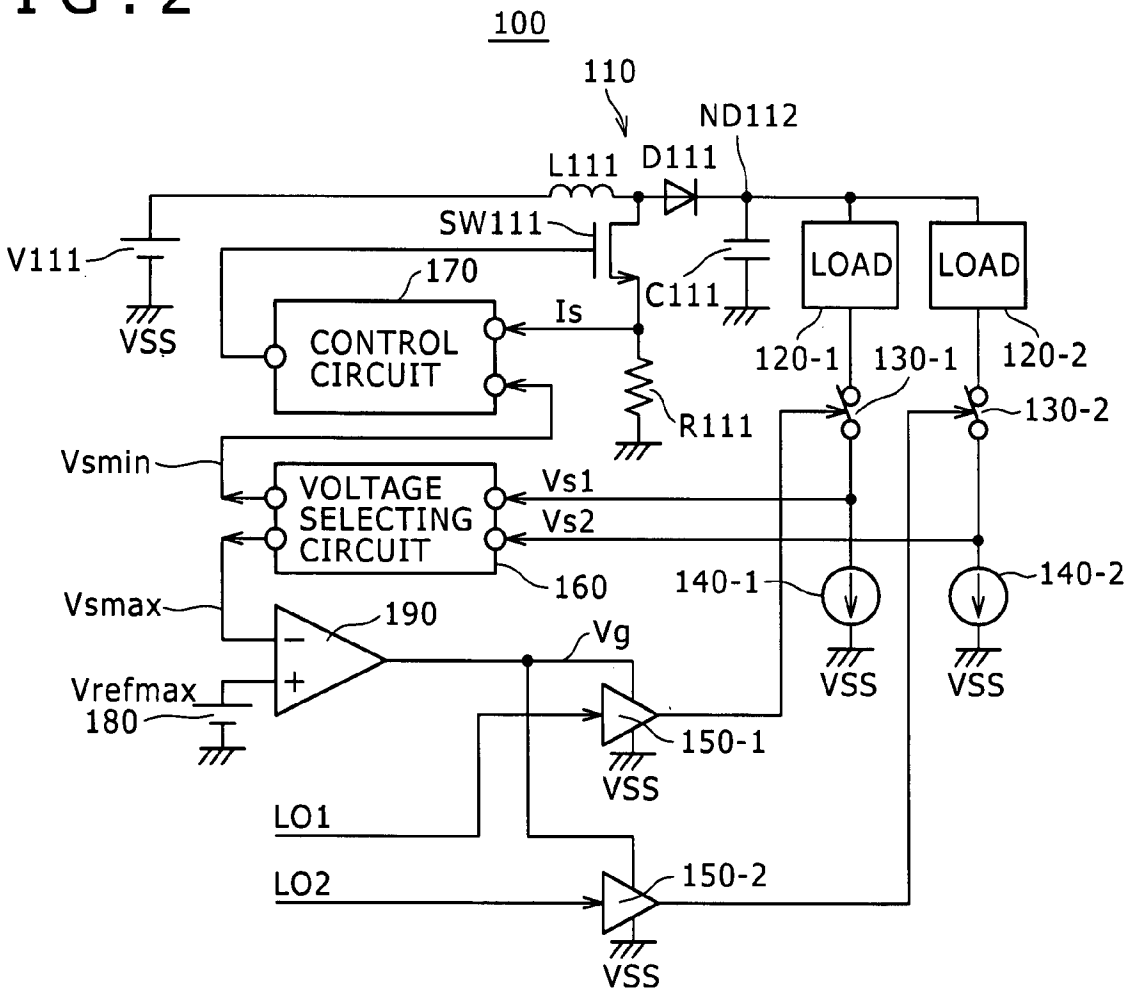
FIG. 2 is a circuit diagram, partly in block form, of a light-emitting element (LED) driving device according to a first embodiment of the present invention.
Figure 3:
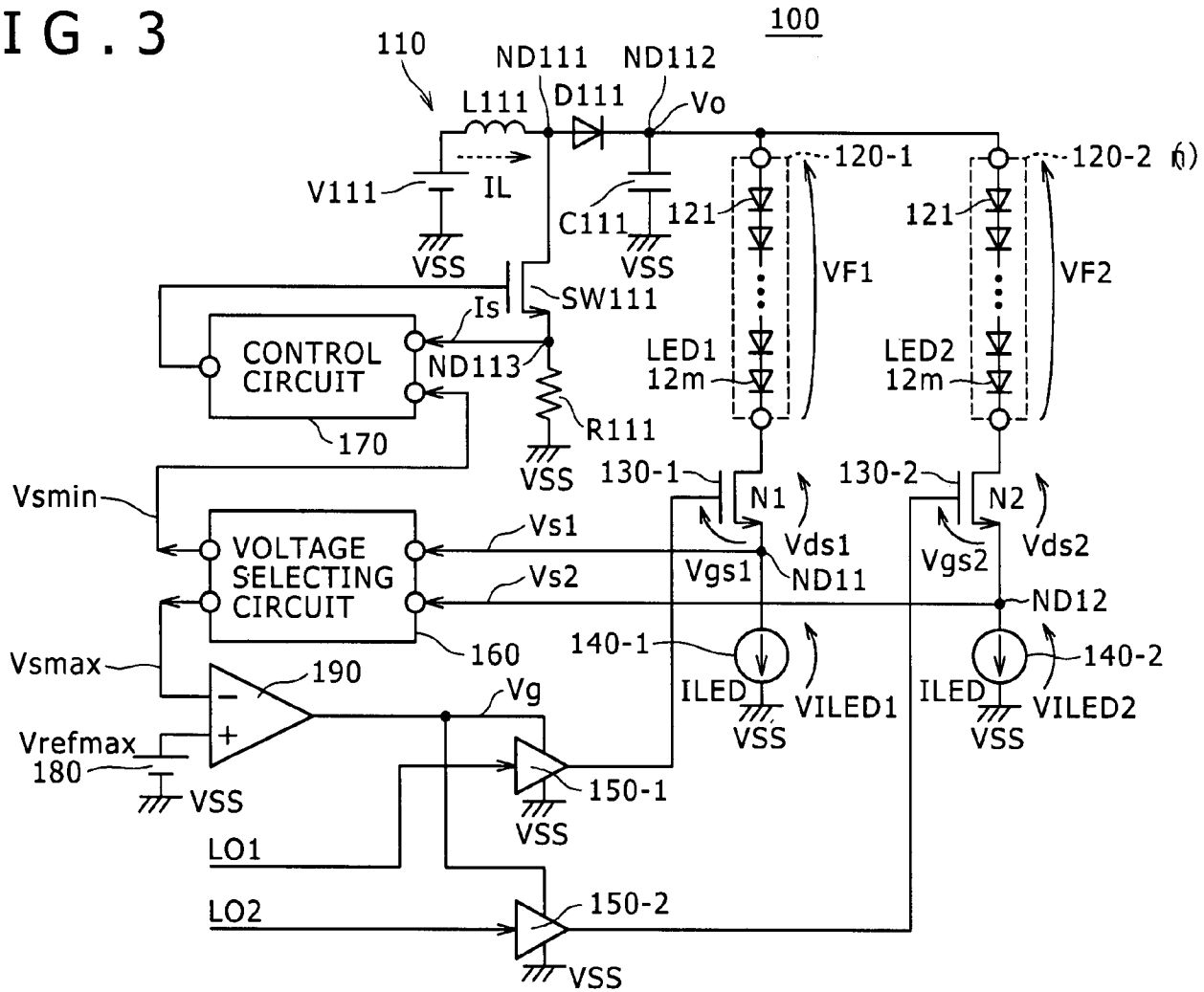
FIG. 3 is a circuit diagram, partly in block form, of the light-emitting element (LED) driving device according to the first embodiment of the present invention.

FIG. 2 is a circuit diagram, partly in block form, of a light-emitting element (LED) driving device according to a first embodiment of the present invention, and FIG. 3 is a circuit diagram, partly in block form, of the light-emitting element (LED) driving device according to the first embodiment of the present invention.

According to the first embodiment, the LED driving device drives LEDs as light-emitting elements which are electrooptic elements for emitting light whose luminance varies depending on a current flowing therethrough.

As shown in FIGS. 2 and 3, the LED driving device, generally denoted by 100, includes a booster-chopper-type switching power supply 110 and a plurality of light emitters 120-1 through **120-*n* (n=2 in FIGS. 2 and 3**) as loads including LED arrays each including a plurality of series-connected LEDs. It is assumed that n=2 in the description which follows.

The LED driving device 100 also includes a constant-current controlling switching transistor 130-1 and a constant-current circuit 140-1 which are connected in series to the light emitter 120-1, and a constant-current controlling switching transistor 130-2 and a constant-current circuit 140-2 which are connected in series to the light emitter 120-2.

The LED driving device 100 further includes switch drivers 150-1, 150-2, a voltage selecting circuit 160, a control circuit 170, a reference voltage source 180, and a control amplifier 190.

The switch drivers 150-1, 150-2, the reference voltage source 180, and the control amplifier 190 jointly make up a voltage controller.

The switching power supply 110 includes a constant-voltage source V111, an inductor L111, a diode D111, an electric storage capacitor C111, a switching transistor SW111, a current detecting resistive element R111, and nodes ND111 through ND113.

The inductor L111 has an end connected to the constant-voltage source V111 which has a voltage VDD and an opposite end connected to the node ND111. The diode D111 has an anode connected to the node ND111 and a cathode connected to the node ND112. The capacitor C111 has a terminal (electrode) connected to the node ND112 and another terminal (electrode) connected to a reference potential VSS, e.g., a ground potential.

The node ND112 is connected as a voltage output node of the switching power supply 110 to respective ends of the light emitters 120-1, 120-2 as loads.

The switching transistor SW111 includes an NMOS transistor which is an n-channel field-effect transistor, for example. The switching transistor SW111 has a drain connected to the node ND111 and a source connected to an end of the resistive element R111. The other end of the resistive element R111 is connected to the reference potential VSS.

The switching power supply 110 thus constructed operates as follows: The control circuit 170 supplies a PWM-controlled pulse signal to turn on and off the switching transistor SW111 to boost the voltage VDD of the constant-voltage source V111 into a boosted voltage Vo.

The switching power supply 110 supplies the boosted voltage Vo to the ends of the light emitters 120-1, 120-2.

Each of the light emitters 120-1, 120-2 includes a series-connected array of LEDs 121 through **12*m***.

The LEDs 121 on ends of the series-connected arrays of the respective light emitters 120-1, 120-2 have anodes connected in common to the voltage output node ND112 of the switching power supply 110.

The LED **12*m* on the other end of the series-connected array of the light emitter 120-1 has a cathode connected to the drain (one terminal) of the switching transistor 130-1**.

The LED **12*m* on the other end of the series-connected array of the light emitter 120-2 has a cathode connected to the drain (one terminal) of the switching transistor 130-2**.

Each of the light emitters 120-1, 120-2 is not limited to a plurality of LEDs, but may include a single LED.

The switching transistor 130-1 has a source (other terminal) connected to a terminal of the constant-current circuit 140-1, whose other terminal is connected to the reference potential VSS.

The switching transistor 130-1 remains turned on during the period of an active high level of a pulsed LED energization signal LO1 that is supplied via the switch driver 150-1 to the gate of the switching transistor 130-1.

At this time, a current ILED1 flows into the light emitter 120-1 which is supplied with the voltage Vo from the switching power supply 110, energizing the LEDs 121 through **12*m* of the light emitter 120-1**.

The switching transistor 130-1 remains turned off during the period of a non-active low level of the pulsed LED energization signal LO. At this time, no current ILED1 flows into the light emitter 120-1 which is supplied with the voltage Vo from the switching power supply 110, de-energizing the LEDs 121 through 12*m* of the light emitter 120-1.

While the switching transistor 130-1 is being energized, a monitor voltage Vs1 at a junction node ND11 between the switching transistor 130-1 and the constant-current circuit 140-1 is as follows:

Basically, the monitor voltage Vs1 is calculated by subtracting the sum ΣVf (=VF) of forward voltages Vf of all the LEDs 121 through 12*m* of the light emitter 120-1 from the voltage Vo supplied from the switching power supply 110.

The monitor voltage Vs1 thus calculated does not take into account a voltage drop across the switching transistor 130-1.

If the switching transistor 130-1 includes a field-effect transistor (FET), for example, then the monitor voltage Vs1 at the junction node ND11 is calculated by subtracting the sum ΣVf of the forward voltages Vf of all the LEDs 121 through 12*m* of the light emitter 120-1 and a drain-to-source voltage Vds1 of the FET as the switching transistor 130-1 from the voltage Vo supplied from the switching power supply 110.

The switching transistor 130-2 has a source (other terminal) connected to a terminal of the constant-current circuit 140-2, whose other terminal is connected to the reference potential VSS.

The switching transistor 130-2 remains turned on during the period of an active high level of a pulsed LED energization signal LO2 that is supplied via the switch driver 150-2 to the gate of the switching transistor 130-2.

At this time, a current ILED2 flows into the light emitter 120-2 which is supplied with the voltage Vo from the switching power supply 110, energizing the LEDs 121 through 12*m* of the light emitter 120-2.

The switching transistor 130-2 remains turned off during the period of a non-active low level of the pulsed LED energization signal LO. At this time, no current ILED2 flows into the light emitter 120-2 which is supplied with the voltage Vo from the switching power supply 110, de-energizing the LEDs 121 through 12*m* of the light emitter 120-2.

While the switching transistor 130-2 is being energized, a monitor voltage Vs2 at a junction node ND12 between the switching transistor 130-2 and the constant-current circuit 140-2 is as follows:

Basically, the monitor voltage Vs2 is calculated by subtracting the sum ΣVf (=VF) of forward voltages Vf of all the LEDs 121 through 12*m* of the light emitter 120-2 from the voltage Vo supplied from the switching power supply 110.

The monitor voltage Vs2 thus calculated does not take into account a voltage drop across the switching transistor 130-2.

If the switching transistor 130-2 includes a field-effect transistor (FET), for example, then the monitor voltage Vs2 at the junction node ND12 is calculated by subtracting the sum ΣVf of the forward voltages Vf of all the LEDs 121 through 12*m* of the light emitter 120-2 and a drain-to-source voltage Vds2 of the FET as the switching transistor 130-2 from the voltage Vo supplied from the switching power supply 110.

The voltage selecting circuit 160 selects a minimum voltage Vsmin and a maximum voltage Vsmax from the monitor voltages Vs1, Vs2 at the nodes ND11, ND12 which are calculated by subtracting the voltage drops across the light emitters 120-1, 120-2 and the switching transistors 130-1, 130-2 from the voltage Vo.

The voltage selecting circuit 160 supplies the selected minimum voltage Vsmin to the control circuit 170, and supplies the selected maximum voltage Vsmax to the control amplifier 190.

The control circuit 170 supplies the gate of the switching transistor SW111 with a pulse signal having a pulse duration depending on the minimum voltage Vsmin selected by the voltage selecting circuit 160.

The switching power supply 110 boosts the voltage VDD of the constant-voltage source V111 by turning on and off the switching transistor SW111 with the pulse signal supplied to the gate thereof.

In this manner, the voltage at the constant-current control terminal of the light emitter 120-1 or 120-2 under a maximum voltage VF is controlled at a constant level.

The control amplifier 190 has an inverting input terminal (−) supplied with the maximum voltage Vsmax selected by the voltage selecting circuit 160 and a noninverting terminal (+) supplied with a preset maximum reference voltage Vrefmax from the reference voltage source 180.

The control amplifier 190 generates a control voltage Vg for making the maximum voltage Vsmax equal to the preset maximum reference voltage Vrefmax, and outputs the control voltage Vg as an operating voltage for the switch drivers 150-1, 150-2.

When the control voltage Vg is applied as the operating voltage to the switch drivers 150-1, 150-2, the gate voltages of the switching transistors 130-1, 130-2 become the voltages at the active high level of the LED energization signals LO1, LO2.

When the switching transistors 130-1, 130-2 are turned on, the control voltage Vg is supplied to the gates thereof.

The monitor voltage for the light emitter 120-2 or 120-1 under a minimum voltage VF is limited so as not to be equal to or higher than the preset maximum reference voltage Vrefmax.

As Vg≠Vrefmax in this case, the relationship Vrefmax=Vsmax=Vg−Vgs1 or Vgs2 (a maximum one of the monitor voltages Vs1, Vs2) is achieved.

Operation of the LED driving device 100 thus constructed will be described below.

The switching power supply 110 supplies the boosted voltage Vo to the ends of the light emitters 120-1, 120-2 as loads.

The switching transistor 130-1 that is connected to the light emitter 120-1 remains turned on during the period of the active high level of the pulsed LED energization signal LO1 that is supplied via the switch driver 150-1 to the gate of the switching transistor 130-1.

At this time, the current ILED1 flows into the light emitter 120-1 which is supplied with the voltage Vo from the switching power supply 110, energizing the LEDs 121 through 12*m* of the light emitter 120-1.

The switching transistor 130-1 remains turned off during the period of the non-active low level of the pulsed LED energization signal LO. At this time, no current ILED flows into the light emitter 120-1 which is supplied with the voltage Vo from the switching power supply 110, de-energizing the LEDs 121 through 12*m* of the light emitter 120-1.

While the switching transistor 130-1 is being energized, the monitor voltage Vs1 at the junction node ND11 between the switching transistor 130-1 and the constant-current circuit 140-1 is supplied to the voltage selecting circuit 160.

The switching transistor 130-2 that is connected to the light emitter 120-2 remains turned on during the period of the active high level of the pulsed LED energization signal LO2 that is supplied via the switch driver 150-2 to the gate of the switching transistor 130-2.

At this time, the current ILED2 flows into the light emitter 120-2 which is supplied with the voltage Vo from the switching power supply 110, energizing the LEDs 121 through 12*m* of the light emitter 120-2.

The switching transistor 130-2 remains turned off during the period of the non-active low level of the pulsed LED energization signal LO2. At this time, no current ILED2 flows into the light emitter 120-2 which is supplied with the voltage Vo from the switching power supply 110, de-energizing the LEDs 121 through 12*m* of the light emitter 120-2.

While the switching transistor 130-2 is being energized, the monitor voltage Vs2 at the junction node ND12 between the switching transistor 130-2 and the constant-current circuit 140-2 is supplied to the voltage selecting circuit 160.

The voltage selecting circuit 160 selects the minimum voltage Vsmin and the maximum voltage Vsmax from the monitor voltages Vs1, Vs2 at the nodes ND11, ND12 which are calculated by subtracting the voltage drops across the light emitters 120-1, 120-2 and the switching transistors 130-1, 130-2 from the voltage Vo.

The voltage selecting circuit 160 supplies the selected minimum voltage Vsmin to the control circuit 170, and supplies the selected maximum voltage Vsmax to the control amplifier 190.

The control circuit 170 generates a pulse signal having a pulse duration depending on the difference between the minimum voltage Vsmin selected by the voltage selecting circuit 160 and a voltage VN113 at the node ND113, and supplies the generated pulsed signal to the gate of the switching transistor SW111 of the switching power supply 110.

The switching power supply 110 boosts the voltage VDD of the constant-voltage source V111 by turning on and off the switching transistor SW111 with the pulse signal supplied to the gate thereof.

In this manner, the voltage at the constant-current control terminal of the light emitter 120-1 or 120-2 under the maximum voltage VF is controlled at a constant level.

The control amplifier 190 generates the control voltage Vg for making the maximum voltage Vsmax equal to the preset maximum reference voltage Vrefmax, and outputs the control voltage Vg as an operating voltage for the switch drivers 150-1, 150-2.

When the control voltage Vg is applied as the operating voltage to the switch drivers 150-1, 150-2, the gate voltages of the switching transistors 130-1, 130-2 become the voltages at the active high level of the LED energization signals LO1, LO2.

When the switching transistors 130-1, 130-2 are turned on, the control voltage Vg is supplied to the gates thereof.

The monitor voltage for the light emitter 120-2 or 120-1 under the minimum voltage VF is limited so as not to be equal to or higher than the preset maximum reference voltage Vrefmax.

A power loss caused by the LED driving device 100 according to the embodiments of the present invention will be described below in comparison with the LED driving device shown in FIG. 1 which will be referred to as a comparative example.

Figure 1:
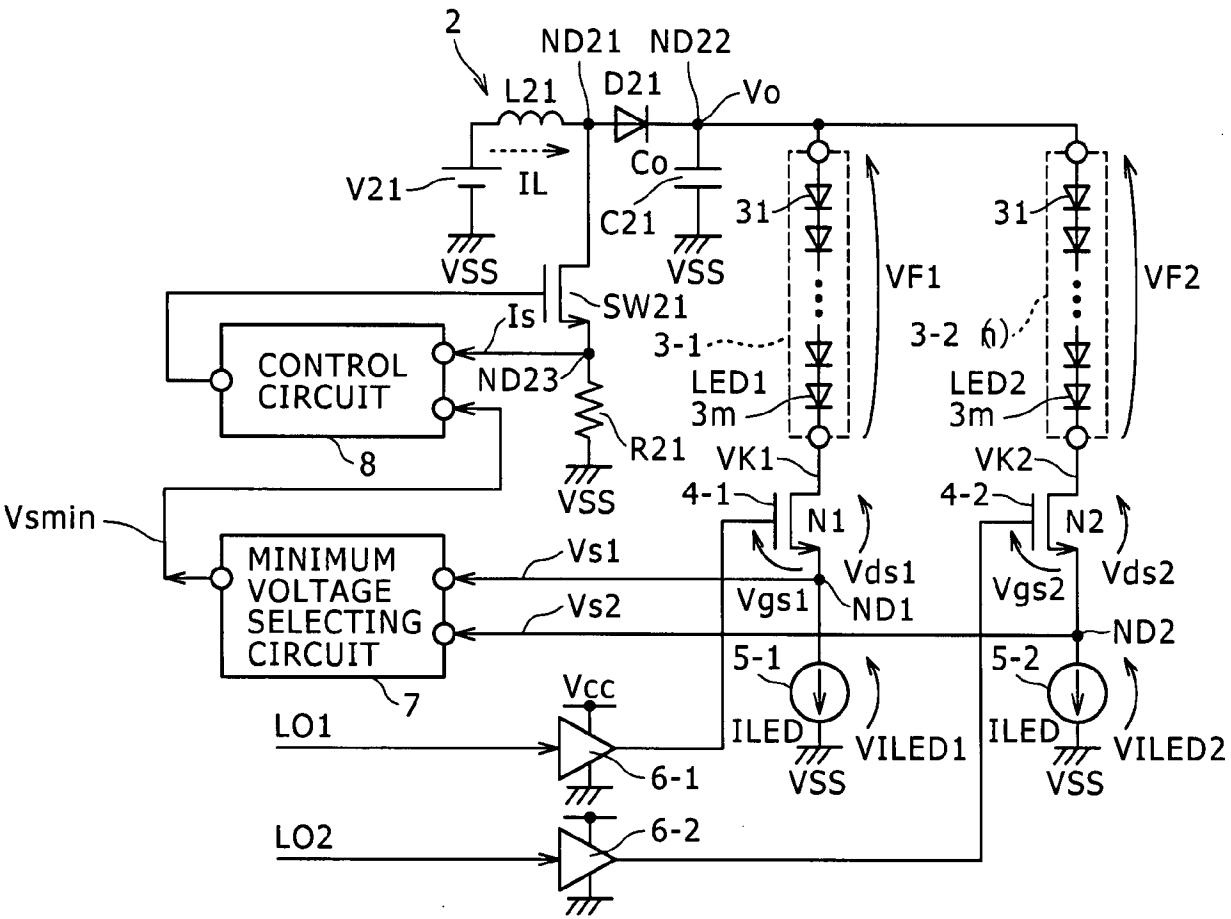
FIG. 1 is a circuit diagram, partly in block form, of a light-emitting element (LED) driving device according to the related art.

[Power Loss Caused by the LED Driving Device 1 According to the Comparative Example Shown in FIG. 1]

First, a power loss caused by the LED driving device 1 according to the comparative example shown in FIG. 1 will be described below.

It is assumed as preconditions that the currents ILED flowing through the light emitters 3-1, 3-2 are of 500 mA, the overall forward voltage VF1 of the light emitter 3-1 is of 50 V, and the overall forward voltage VF2 of the light emitter 3-2 is of 45 V.

It is also assumed as preconditions that the control voltage for the minimum voltage Vsmin is of 0.5 V, and the switching transistors 4-1, 4-2 have respective gate-to-source voltages Vgs1, Vgs2 which are equal to each other (Vgs1=Vgs2).

It is further assumed as preconditions that the switching transistors 4-1, 4-2 have respective on resistances Ro (N1), Ro (N2) of 1 ohms (Ω) (Ro (N1)=Ro (N2)=Ω) and respective drain-to-source voltages Vds1, Vds2, and the constant-current circuit 5-1, 5-2 have respective voltages VILED1, VILED2 developed thereacross.

Based on the above preconditions, the output voltage Vo of the switching power supply 110 is calculated as follows:

$$\begin{aligned} Vo &= VILED1 + Vds1 + VF1 \\ &= 0.5\ \text{V} + (100\ \text{mA} \times 1\Omega) + 50\ \text{V} \\ &= 50.6\ \text{V} \end{aligned}$$

The voltage VILED2 across the constant-current circuit is calculated as follows:

$$\begin{aligned} VILED2 &= Vo - VF2 - Vds2 \\ &= 50.6\ \text{V} - 45\ \text{V} - (100\ \text{mA} \times 1\Omega) \\ &= 5.5\ \text{V} \end{aligned}$$

A power loss Pd (ILED2) caused by the constant-current circuit 5-2 associated with the light emitter 3-2 which has the lower forward voltage VF and a power loss Pd (N2) caused by the switching transistor 4-2 are calculated as follows:

$$Pd(ILED2)=5.5\ \text{V} \times 100\ \text{mA}=550\ \text{mW}$$

$$Pd(N2)=(100\ \text{mA})^2 \times 1\Omega=10\ \text{mW}$$

A power loss Pd (ILED1) caused by the constant-current circuit 5-1 associated with the light emitter 3-1 which has the higher forward voltage VF and a power loss Pd (N1) caused by the switching transistor 4-1 are calculated as follows:

$$Pd(\text{ILED1})=0.5\ \text{V} \times 100\ \text{mA}=50\ \text{mW}$$

$$Pd(N1)=(100\ \text{mA})^2 \times 1\Omega=10\ \text{mW}$$

With the LED driving device 1 according to the comparative example shown in FIG. 1, therefore, the power loss Pd (ILED2) caused by the constant-current circuit 5-2 associated with the light emitter 3-2 which has the lower forward voltage VF is of 550 mW, and the power loss Pd (ILED1) caused by the constant-current circuit 5-1 associated with the light emitter 3-1 which has the higher forward voltage VF is of 50 mW.

Consequently, the constant-current circuit 5-2 associated with the light emitter 3-2 which has the lower forward voltage VF causes a much larger power loss (the power loss Pd (ILED2)) that is eleven times the power loss Pd (ILED2) caused by the constant-current circuit 5-2.

The power loss Pd (N2) caused by the switching transistor 4-2 and the power loss Pd (N1) caused by the switching transistor 4-1 are of 10 mW and equal to each other.

[Power Loss Caused by the LED Driving Device 100 According to the Present Embodiment]

Next, a power loss caused by the LED driving device 100 according to the present embodiment will be described below.

For an easier understanding of the present embodiment, the various parameters are denoted by reference characters which are identical to those of the comparative example.

It is assumed as preconditions that the current ILED1, ILED2 flowing through the light emitters 120-1, 120-2 are of 500 mA, the overall forward voltage VF1 of the light emitter 120-1 is of 50 V, and the overall forward voltage VF2 of the light emitter 120-2 is of 45 V.

It is also assumed as preconditions that the control voltage for the minimum voltage Vsmin is of 0.5 V, the control voltage for the maximum voltage Vsmax is of 1.0 V, and the switching transistors 130-1, 130-2 have respective gate-to-source voltages Vgs1, Vgs2 which are equal to each other (Vgs1=Vgs2).

It is further assumed as preconditions that the switching transistors 130-1, 130-2 have respective on resistances Ro (N1), Ro (N2) of 1 ohms (Q) (Ro (N1)=Ro (N2)=0) and respective drain-to-source voltages Vds1, Vds2, and the constant-current circuits 140-1, 140-2 have respective voltages VILED1, VILED2 developed thereacross.

Based on the above preconditions, the output voltage Vo of the switching power supply 110 is calculated as follows:

$$\begin{aligned} Vo &= VILED1 + Vds1 + VF1 \\ &= 0.5\ \text{V} + (100\ \text{mA} \times 1\Omega) + 50\ \text{V} \\ &= 50.6\ \text{V} \end{aligned}$$

The voltage VILED2 across the constant-current circuit 140-2 and the drain-to-source voltage Vds2 of the switching transistor 130-2 are calculated as follows:

$$VILED2 = Vsmax\ \text{control voltage} = 1.0\ \text{V}$$

$$\begin{aligned} Vds2 &= Vo - VF2 - VILED \\ &= 50.6\ \text{V} - 45\ \text{V} - 1.0\ \text{V} \\ &= 4.6\ \text{V} \end{aligned}$$

A power loss Pd (ILED2) caused by the constant-current circuit 140-2 associated with the light emitter 120-2 which has the lower forward voltage VF and a power loss Pd (N2) caused by the switching transistor 130-2 are calculated as follows:

$$Pd(ILED2)=1.0\ \text{V}\times 100\ \text{mA}=100\ \text{mW}$$

$$Pd(N2)=4.6\ \text{V}\times 100\ \text{mA}=460\ \text{mW}$$

A power loss Pd (ILED1) caused by the constant-current circuit 140-1 associated with the light emitter 120-1 which has the higher forward voltage VF and a power loss Pd (N1) caused by the switching transistor 130-1 are calculated as follows:

$$Pd(ILED1)=0.5\ \text{V}\times 100\ \text{mA}=50\ \text{mW}$$

$$Pd(N1)=(100\ \text{mA})^2\times 1\Omega=10\ \text{mW}$$

With the LED driving device 100 according to the present embodiment, therefore, the power loss Pd (ILED2) caused by the constant-current circuit 140-2 associated with the light emitter 120-2 which has the lower forward voltage VF is of 100 mW, and the power loss Pd (N2) caused by the switching transistor 130-2 is of 460 mW.

Consequently, the LED driving device 100 according to the present embodiment makes it possible to assign desired power losses to the constant-current (ILED) circuit and the switch (NMOS) by setting the control voltage for the maximum voltage Vmax.

According to the present embodiment, the LED driving device 100 allows heat sources to be distributed and can be designed for heat optimization with increased ease.

If the LED driving device 100 has a plurality of constant-current (ILED) circuits such as four channels, eight channels, and so on, then it is effective to be able to set upper limits for power loss as desired from the standpoint of allowable losses (heat).

The power loss Pd (ILED1) caused by the constant-current circuit 140-1 associated with the light emitter 120-1 which has the higher forward voltage VF is of 50 mW, and the power loss Pd (N1) caused by the switching transistor 130-1 is of 10 mW.

As described above, the first embodiment of the present invention offers the following advantages:

If the forward voltage Vf of each LED varies to a value lower than a standard value, for example, then the LED driving device 100 according to the present embodiment operates as follows:

The voltages applied to the constant-current circuits can be reduced, reducing power consumption of the constant-current circuits and preventing electric power efficiency thereof from being reduced.

Particularly, it is possible to assign desired power consumption rates to the constant-current circuit 140-2 or 140-1 associated with the light emitter 120-2 or 120-1 which is not under the maximum voltage VF.

As a result, the power losses caused by the constant-current circuits are reduced and hence the heat generated thereby is reduced.

2. Second Embodiment

Figure 4:
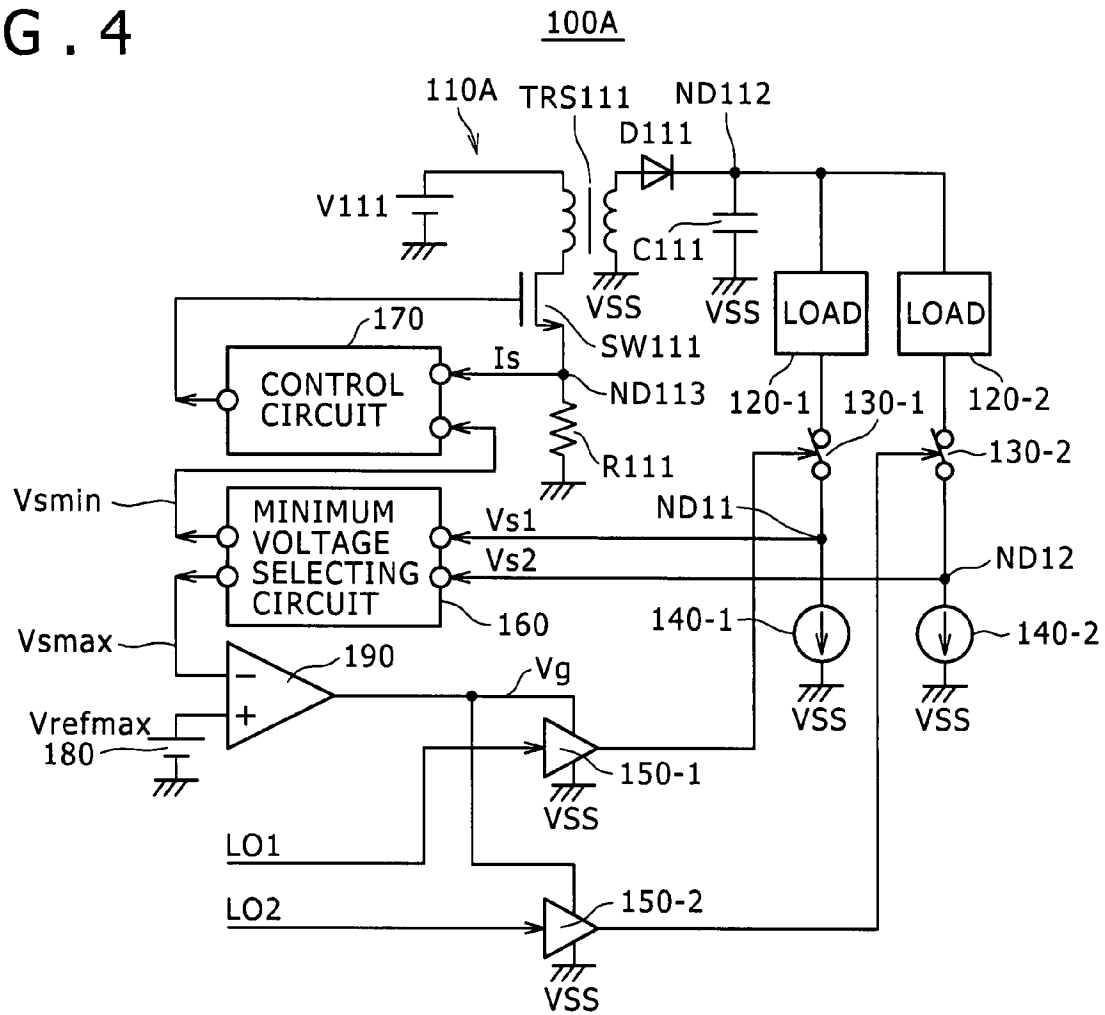
FIG. 4 is a circuit diagram, partly in block form, of a light-emitting element (LED) driving device according to a second embodiment of the present invention.

FIG. 4 is a circuit diagram, partly in block form, of a light-emitting element (LED) driving device 100A according to a second embodiment of the present invention.

The LED driving device 100A according to the second embodiment is different from the LED driving device 100 according to the first embodiment as follows:

The power supply 110 of the LED driving device 100 according to the first embodiment includes a booster-chopper-type switching power supply.

However, the LED driving device 100A according to the second embodiment has a power supply 110A which includes a current-mode flyback converter including a transformer TRS111.

The other details of the LED driving device 100A according to the second embodiment are identical to those of the LED driving device 100 according to the first embodiment.

The LED driving device 100A according to the second embodiment offers the same advantages as those of the LED driving device 100 according to the first embodiment.

The LED driving devices 100, 100A according to the first and second embodiments are suitable for use in transmissive liquid crystal display devices which incorporate a backlight device.

3. Third Embodiment

A liquid crystal display device according to a third embodiment of the present invention, which incorporates an LED backlight to which the LED driving devices 100, 100A according to the first and second embodiments shown in FIGS. 2 through 4 are applicable, will be described below.

Figure 5:
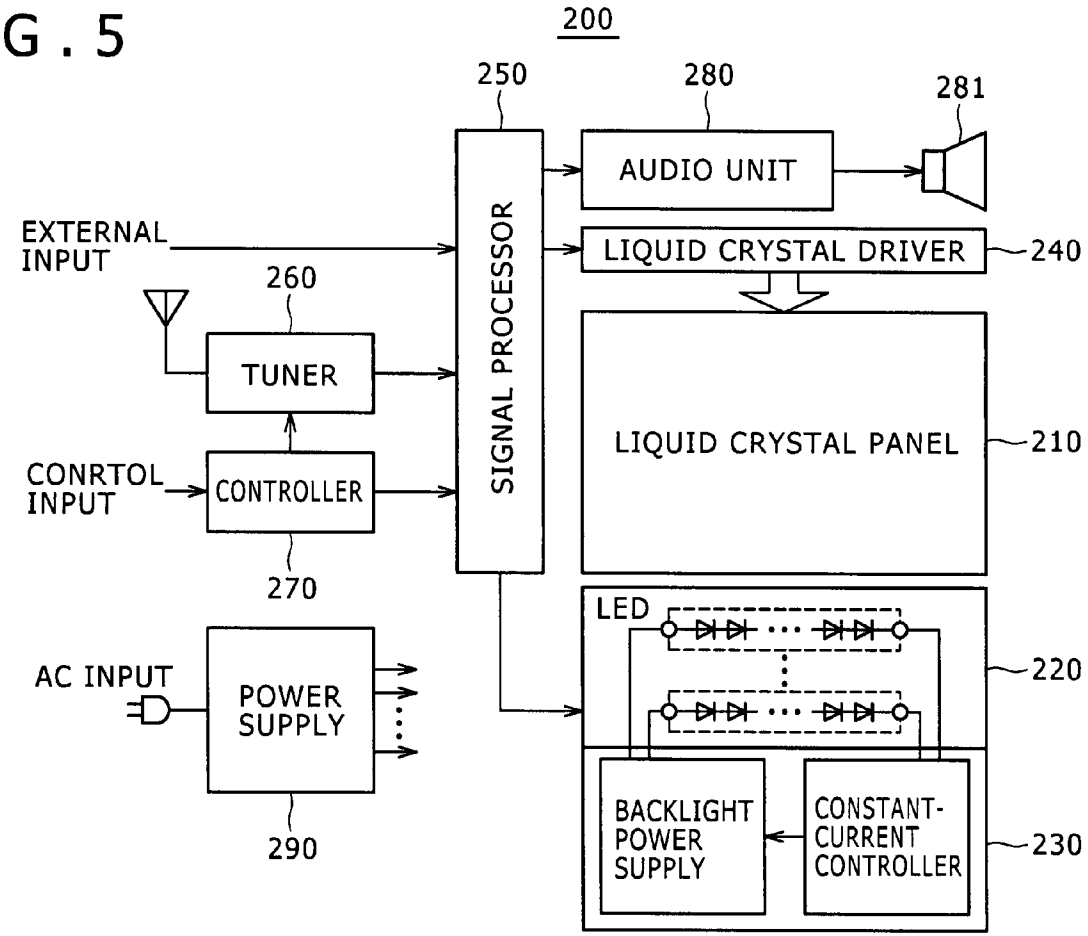
FIG. 5 is a block form of a liquid crystal display device according to a third embodiment of the present invention.

FIG. 5 is a block form of a liquid crystal display device 200 according to the third embodiment of the present invention.

As shown in FIG. 5, the liquid crystal display device 200 includes a transmissive liquid crystal display (LCD) panel 210, a backlight device 220 as an illumination unit disposed behind the LCD panel 210, an LED driving device 230, and a liquid crystal driver (panel driving circuit) 240.

The liquid crystal display device 200 also includes a signal processor 250, a tuner 260, a controller 270, an audio unit 280 including a speaker 281, and a power supply 290.

Figure 6:
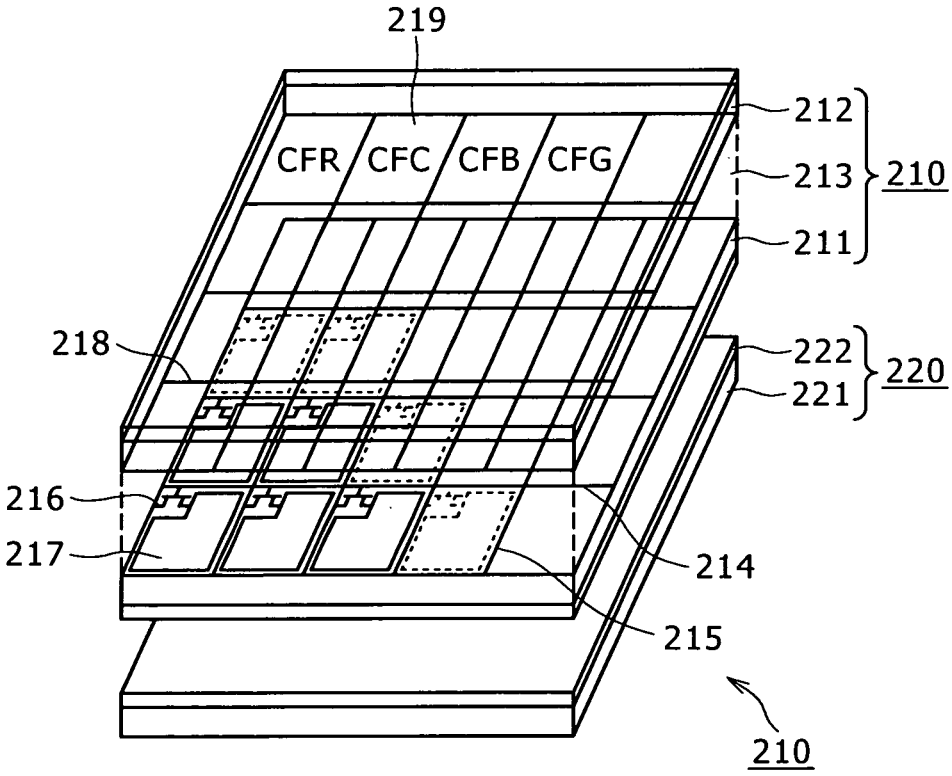
FIG. 6 is a perspective view of a transmissive LCD panel.

FIG. 6 is a perspective view of the transmissive LCD panel 210.

As shown in FIG. 6, the transmissive LCD panel 210 includes a TFT substrate 211, a counter electrode substrate 212 disposed in confronting relation to the TFT substrate 211, and a liquid crystal layer 113 with a twisted nematic (TN) liquid crystal sealed therein, interposed between the TFT substrate 211 and the counter electrode substrate 212.

The TFT substrate 211 has a matrix of signal lines 214 and scanning lines 215, thin-film transistors 216 disposed as switching elements at the intersections of the signal lines 214 and the scanning lines 215, and pixel electrodes 217 disposed at the intersections of the signal lines 214 and the scanning lines 215, all disposed on an inner surface thereof.

The thin-film transistors 216 are successively selected by the scanning lines 215, and write image signals supplied from the signal lines 214 into the corresponding pixel electrodes 217. The counter electrode substrate 212 has counter electrodes 218 and color filters 219 disposed on an inner surface thereof.

The transmissive LCD panel 210 is sandwiched between two polarizers. While the transmissive LCD panel 210 is being illuminated with white light from the backlight device 220 disposed therebehind, the transmissive LCD panel 210 is driven in an active matrix mode to display desired full-color images.

The backlight device 220 includes a light source 221 and a wavelength selection filter 222.

The light source 221 includes a plurality of LED arrays each including the light emitter 120 to be driven according to the first or second embodiment of the present invention.

The backlight device 220 applies light emitted from the light source 221 through the wavelength selection filter 222 to the transmissive LCD panel 210 from behind.

The backlight device 220 shown in FIG. 6 is disposed behind the transmissive LCD panel 210 and includes a direct-lighting backlight device disposed behind the transmissive LCD panel 210, for illuminating the transmissive LCD panel 210 from behind.

The light source 221 of the backlight device 220 employs a plurality of series-connected LEDs as light emission sources.

Specifically, each of the LED arrays includes a plurality of series-connected LEDs arranged in the plane of the backlight device 220, and the LED arrays are also arranged in the plane of the backlight device 220.

The backlight device 220 thus constructed is driven by the LED driving device 230.

The LED driving device 230 may be either one of the LED driving devices 100, 100A according to the first and second embodiments shown in FIGS. 2 through 4.

In FIG. 6, the entire light source 221 is illustrated as being driven by the LED driving device 230. However, each of the LED arrays of series-connected LEDs may be associated with and driven by an individual LED driving device.

The liquid crystal driver 240 includes an X driver circuit, a Y driver circuit, etc. The signal processor 250 supplies separate R, G, B signals, for example, to the X driver circuit and the Y driver circuit to drive the LCD panel 210 for thereby displaying color images based on the separate R, G, B signals.

The signal processor 250 performs signal processing such as chroma processing on video signals input from the tuner 260 and an external source, converts the processed video signals from composite signals into separate R, G, B signals suitable for driving the LCD panel 210, and supplies the converted separate R, G, B signals to the panel driving circuit 240, which drives the LCD panel 210 to display color images based on the separate R, G, B signals.

The signal processor 250 also extracts audio signals from the video signals input thereto and supplies the audio signals to the audio unit 280, which energizes the speaker 281 to produce sounds based on the audio signals.

The liquid crystal display device 200 thus constructed incorporates therein either one of the LED driving devices 100, 100A shown in FIGS. 2 through 4.

In the liquid crystal display device 200, therefore, the voltages applied to the constant-current circuits can be reduced, reducing power consumption of the constant-current circuits and preventing electric power efficiency thereof from being reduced.

Particularly, it is possible to assign desired power consumption rates to the constant-current circuit associated with the light emitter which is not under the maximum voltage VF.

As a result, the power losses caused by the constant-current circuits are reduced and hence the heat generated thereby is reduced.

The present application contains subject matter related to that disclosed in Japanese Priority Patent Application JP 2010-115239 filed in the Japan Patent Office on May 19, 2010, the entire content of which is hereby incorporated by reference.

Although certain preferred embodiments of the present invention have been shown and described in detail, it should be understood that various changes and modifications may be made therein without departing from the scope of the appended claims.

What is claimed is:

1. A light-emitting element driving device comprising:

a plurality of light emitters each including at least one light-emitting element for emitting light at a luminance level depending on a current flowing therethrough;

a power supply for adjusting an output voltage depending on a signal supplied to a control terminal of a switch device and supplying the output voltage to ends of said light emitters;

a plurality of current control transistors connected between respective other ends of said light emitters and a reference potential, said current control transistors being rendered conductive by respective energization signals;

a plurality of constant-current circuits connected respectively in series to said current control transistors between the other ends of said light emitters and reference potential;

a voltage selecting circuit for selecting a minimum voltage and a maximum voltage from junction terminal voltages between said current control transistors and said constant-current circuits;

a control circuit for outputting a signal having a pulse duration depending on the minimum voltage selected by said voltage selecting circuit, to the control terminal of said switch device; and a voltage controller for generating a control voltage so as to make the maximum voltage selected by said voltage selecting circuit equal to or smaller than a preset maximum reference voltage and setting the level of said energization signals to the level of said control voltage.

2. The light-emitting element driving device according to claim 1, wherein said control circuit controls the output voltage from said power supply depending on the junction terminal voltage between the current control transistor and the constant-current circuit which are connected to one of said light emitters under a maximum forward voltage; and said voltage controller controls a junction terminal voltage other than the junction terminal voltage between the current control transistor and the constant-current circuit which are connected to one of said light emitters under a minimum forward voltage, so as not to be equal to or greater than said preset maximum reference voltage.

3. The light-emitting element driving device according to claim 1, wherein said current control transistors include field-effect transistors, respectively, having respective drains connected to the corresponding other ends of said light emitters and respective sources connected to the respective constant-current circuits which are connected in series to said current control transistors.

4. The light-emitting element driving device according to claim 1, wherein said voltage controller includes:

a control amplifier for generating said control voltage so as to make the maximum voltage selected by said voltage selecting circuit equal to or smaller than said preset maximum reference voltage; and a driver responsive to said control voltage applied as a drive voltage, for supplying said energization signals at the level of said control voltage to respective gates of the corresponding current control transistors.

5. The light-emitting element driving device according to claim 1, wherein said power supply includes:

a switching power supply including an inductor or a transformer, a capacitor, and a switching transistor, for adjusting the output voltage by turning on and off said switching transistor.

6. A display device comprising:

a transmissive display unit;

an illumination unit for illuminating said transmissive display unit with emitted light, said illumination unit including a plurality of light emitters each including at least one light-emitting element for emitting light at a luminance level depending on a current flowing therethrough; and a light-emitting element driving device for driving the light-emitting elements of said light emitters, wherein said light-emitting element driving device includes a power supply for adjusting an output voltage depending on a signal supplied to a control terminal of a switch device and supplying the output voltage to ends of said light emitters, a plurality of current control transistors connected between respective other ends of said light emitters and a reference potential, said current control transistors being rendered conductive by respective energization signals, a plurality of constant-current circuits connected respectively in series to said current control transistors between the other ends of said light emitters and reference potential, a voltage selecting circuit for selecting a minimum voltage and a maximum voltage from junction terminal voltages between said current control transistors and said constant-current circuits, a control circuit for outputting a signal having a pulse duration depending on the minimum voltage selected by said voltage selecting circuit, to the control terminal of said switch device, and a voltage controller for generating a control voltage so as to make the maximum voltage selected by said voltage selecting circuit equal to or smaller than a preset maximum reference voltage and setting the level of said energization signals to the level of said control voltage.

7. The display device according to claim 6, wherein said control circuit controls the output voltage from said power supply depending on the junction terminal voltage between the current control transistor and the constant-current circuit which are connected to one of said light emitters under a maximum forward voltage; and said voltage controller controls a junction terminal voltage other than the junction terminal voltage between the current control transistor and the constant-current circuit which are connected to one of said light emitters under a minimum forward voltage, so as not to be equal to or greater than said preset maximum reference voltage.

8. The display device according to claim 6, wherein said current control transistors include field-effect transistors, respectively, having respective drains connected to the corresponding other ends of said light emitters and respective sources connected to the respective constant-current circuits which are connected in series to said current control transistors.

9. The display device according to claim 6, wherein said voltage controller includes:

a control amplifier for generating said control voltage so as to make the maximum voltage selected by said voltage selecting circuit equal to or smaller than said preset maximum reference voltage; and a driver responsive to said control voltage applied as a drive voltage, for supplying said energization signals at the level of said control voltage to respective gates of the corresponding current control transistors.

10. The display device according to claim 6, wherein said power supply includes:

a switching power supply including an inductor or a transformer, a capacitor, and a switching transistor, for adjusting the output voltage by turning on and off said switching transistor.

* * * * *